United States Patent [19]

Bright

[11] Patent Number: 4,926,772

[45] Date of Patent: May 22, 1990

[54] EMERGENCY PADDLE KIT

[76] Inventor: Vernon G. Bright, 298 Highfield Road, Toronto, Ontario, Canada, M4L 2V5

[21] Appl. No.: 414,153

[22] Filed: Sep. 27, 1989

Related U.S. Application Data

[63] Continuation-in-part of Ser. No. 185,725, Apr. 25, 1988, abandoned.

[51] Int. Cl.[5] ..... B63H 16/04

[52] U.S. Cl. ..... 114/39.2; 440/101

[58] Field of Search ..... 440/101, 102, 103; 416/70 R, 74, 82; 114/221 R, 39.2, 89

[56] References Cited

U.S. PATENT DOCUMENTS

| | | | |
|---|---|---|---|
| 3,799,099 | 3/1974 | Conover | 114/221 |
| 3,970,032 | 7/1976 | Phillips | 440/101 |
| 4,194,458 | 3/1980 | Messing | 114/39.1 |

FOREIGN PATENT DOCUMENTS

| | | | |
|---|---|---|---|
| 959131 | 1/1964 | France | 416/70 |
| 434123 | 8/1947 | Italy | 440/101 |

*Primary Examiner*—Sherman D. Basinger
*Assistant Examiner*—Edwin L. Swinehart
*Attorney, Agent, or Firm*—Arne I. Fors

[57] ABSTRACT

An emergency paddle kit for sailboards is disclosed. The kit comprises at least one shaft which has a paddle blade attached to one end, which shaft is releasably attached to the boom of a sailboard. When the sail of the sailboard is not used to propel the sailboard through the water, the shaft may be released from the boom and the paddle may be used to propel the sailboard through the water. The emergency kit may further comprise a second shaft which has a second paddle blade attached to one end, which second shaft is also releasably attached to the boom of the sailboard. The first and second shafts may be connected together to form a kayak-type paddle which may then be utilized to propel the sailboard through the water. The emergency kit may further comprise a number of attachments, such as shaft extensions and a paddle handle which may be attached to the shaft and/or to each other.

9 Claims, 2 Drawing Sheets

EMERGENCY PADDLE KIT

This application is a continuation-in-part of application Serial No.: 185,725 filed Apr. 25, 1988, now abandoned.

BACKGROUND OF THE INVENTION

This invention relates to an emergency paddle kit for use with a sailboard.

It is not uncommon for people using sailboards to be becalmed or caught in extremely rough conditions where it is impossible or dangerous for them to carry On sailing. They may become trapped by these weather conditions a fair distance from shore and have to paddle to shore using their hands or feet. This obviously is fairly difficult to do without expending a great deal of energy and effort.

A conventional paddle is too bulky to be conveniently carried on a sailboard, and lacks means for attaching it to the sailboard.

SUMMARY OF THE INVENTION

It is an object of the present invention to provide a compact emergency kit for a sailboard, including a paddle which will tend to allow the person to paddle the sailboard to the shore with greater ease.

It is a further object to provide means for attaching such a kit to the sailboard.

The present invention therefore comprises at least one paddle having a shaft and a paddle blade formed at one end of the shaft, and means positioned on the shaft for releasably attaching the shaft to the boom of a sailboard.

The means for releasably attached the shaft to the boom may be in the form of an elasticized cord which passes through a hole in the shaft and which has a knob on one end, and a knob-receiving loop on the other end. The cord is passed around the boom and the knob is fitted into the knob-receiving loop, thereby attaching the shaft to the boom. When the sail of the sailboard is not used to propel the sailboard through the water, the shaft is released from the boom by simply passing the knob back through the knob-receiving loop and the paddle may then be used to propel the sailboard through the water. Two such means preferably are utilized to attach each shaft to the boom more securely and more snugly, so that the shafts and paddle blades do not interfere with the person using the sailboard. The first means may be positioned proximate the paddle blade end of the shaft and the second means may be positioned proximate the free end of the shaft.

The emergency paddle kit may contain a second paddle having a shaft and a blade formed at one end of the shaft, and a means positioned on the second shaft for attaching the second shaft to the boom. A means for connecting the free ends of the first and second shafts together is also provided. This connecting means may comprise a tube of substantially the same diameter as the internal diameter of both the first and second shafts, said shafts being hollow for insertion into said hollow shafts. The tube has at least one spring-loaded button for releasable engagement with a button shaped opening in at least one of the first and second shafts and preferably is rigidly connected to the other of the hollow shafts such as by a rivet. When the connecting tube is inserted into the shafts and the first and second shafts are abutted, the opening in at least one of the first and second shafts corresponds to the location of the button on the tube for a snug interconnection. When the sail cannot be used to propel the sailboard through the water, the first and second shafts may be released from the boom and the free ends of the first and second shafts may be connected together to a form a kayak-type paddle. This paddle may then be used to used to propel the sailboard through the water.

The emergency paddle kit may further comprise a number of other attachments which may be connected to the shaft. For example, a shaft extension or a paddle handle may be provided in the emergency kit. These attachments may have a hollow shaft portion for connecting the attachments to the shaft. The attachment means may comprise a tube having two spaced apart spring-loaded buttons for releasable engagement with a button shaped opening in each of the shaft and shaft portions of the attachments. The distance between the openings when the shaft and shaft portions are abutted corresponds to the distance between the buttons on the tube.

BRIEF DESCRIPTION OF THE DRAWINGS

The preferred embodiment of the present invention will now be more fully described with reference to the accompanying drawings, in which.

DETAILED DESCRIPTION OF THE PREFERRED EMBODIMENT

Figure 1:
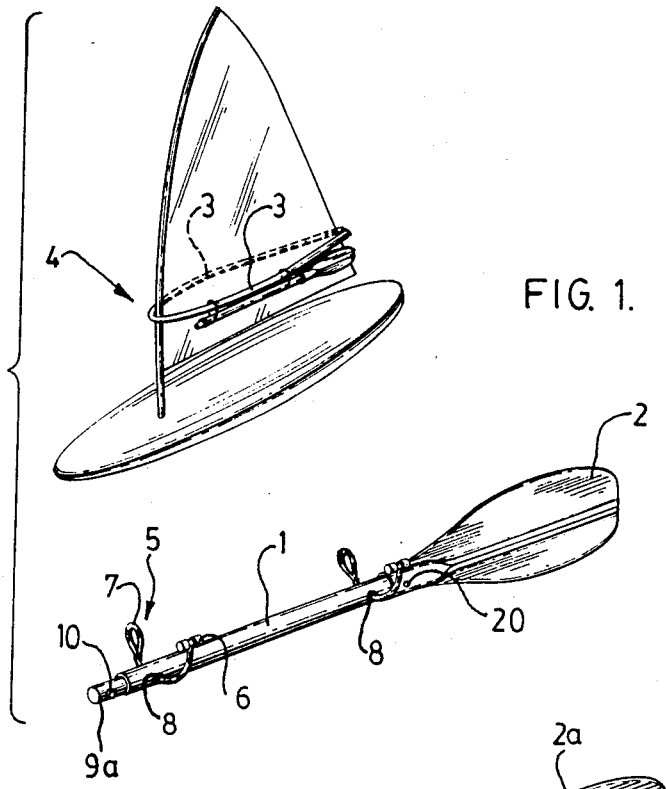
FIG. 1 is a perspective view of the paddle of the emergency kit preparatory to securement of the paddle to the wish-bone boom of a sailboard, and of a said paddle, enlarged in size for illustration purposes, secured to the said boon of a sailboard.

Referring to the drawings, there is provided a shaft 1 which has a paddle blade 2 formed at one end such as by insertion of shaft 1 into a socket in blade 2 for a tight friction fit therebetween. A means is provided for releasably attaching the shaft 1 to the boom 3 of a sailboard sail 4. This means comprises an elasticized cord 5 which has a knob 6 at one end and a knob-receiving loop 7 at its other end. The cord 5 is passed through a slot 8 in the shaft 1. In order to attach the shaft 1 to the boom 3, the elasticized cord 5 is passed around the boom 3 and the knob 6 is passed through the knob-receiving loop 7. When the paddle must be used, the knob 6 is passed back through the knob-receiving loop 7, thereby releasing the shaft 1 from the boom 3.

Although the description will proceed with reference to the use of elasticized cord, commonly known as "shock cord", other means of attachment may be used to attach the shaft 1 to the boom 3, such as for example hook and pile fasteners known as "velcro" ®.

Figure 2:
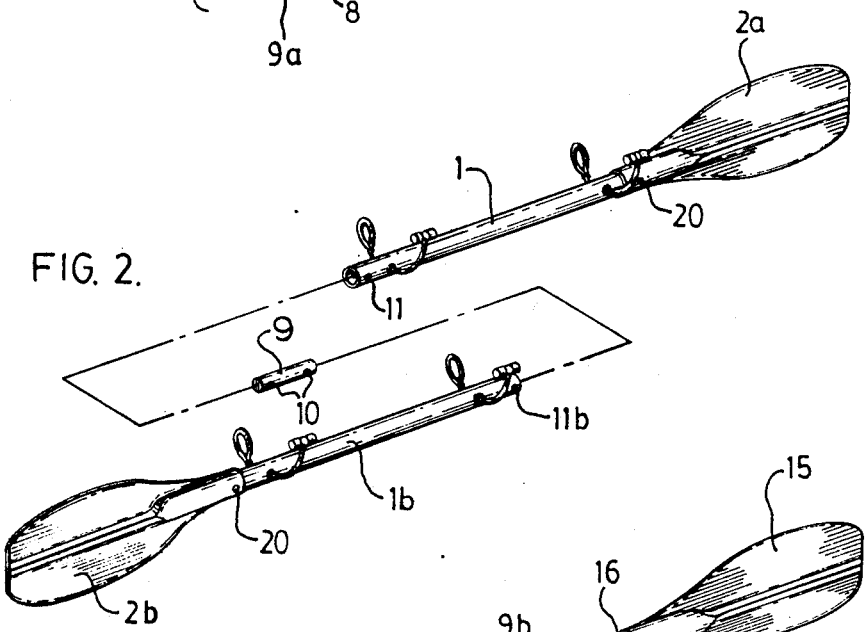
FIG. 2 is an exploded view of the kayak-type paddle of the emergency kit.

The emergency paddle kit may further comprise a second shaft **1*b* which has a second paddle blade 2*b* formed at one end, such as shown in FIG. 2. As illustrated in FIGS. 1 and 2, each of the first shaft 1 and the second shaft 1*b* preferably has a pair of spaced-apart securing means positioned on it for releasably attaching it to the boom 3 of a sailboard sail 4**, the first securing means positioned proximate the paddle blade end of the shaft and the second securing means positioned proximate the free end of the shaft.

The two shafts 1, 1*b* can also be attached to each other to form a kayak-type paddle The two hollow shafts are connected together by way of a tube 9 of substantially the same diameter as the internal diameter of both of the shafts 1, 1*b* for snug insertion of tube 9 thereinto. The tube 9 may have two spaced apart spring-loaded buttons 10 for releasable engagement with mating button shaped openings 11, 11*b* in the shafts 1, 1*b*. When the shafts are abutted, the distance between the openings 11, 11*b* corresponds to the distance between the buttons 10. As a preferred alternative, tube 9*a* may be inserted into a hollow shaft 1 and riveted therein, as shown in FIG. 1, the projecting portion having a spring-loaded button 10 for engagement with a mating button-shaped opening 11*b* in shaft 1*b*.

Figure 3:
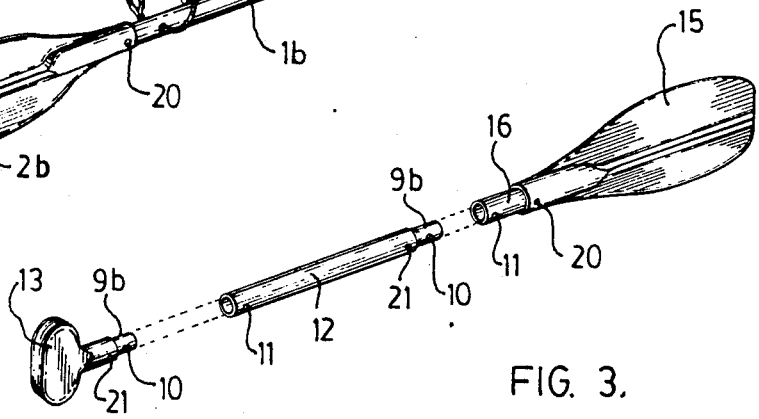
FIG. 3 is an exploded view of the paddle of the emergency kit showing possible attachments which may be connected to the paddle.

With reference now to FIG. 3, a collapsible paddle comprising various attachments such as a shaft extension 12, and/or paddle handle 13 for a paddle blade 15 are shown. These attachments include hollow shaft portions which are used to connect the attachments to each other or to the hollow shaft 16 extending from paddle blade 15 and secured thereto by rivet 20. The connection may be made by way of a tube 9 which has two spaced apart spring-loaded buttons 10 positioned on it for releasable engagement with button-shaped openings positioned on the shaft 1*b* or shaft portions of the attachments, as typified in FIG. 2, or more preferably by tubes 9*b* which are secured in the hollow shaft portions of handle 13 and extension 12 by rivets 21 and have spring-loaded buttons 10 on their free ends for releasable engagement with mating button-shaped openings 11. The tube 9 is of substantially the same diameter as the internal diameter of the shaft lb and shaft portions of the attachments. The hollow shafts, shaft extensions, and connecting rubes preferably are filled with a light-weight rigid foamed plastic for flotation.

Figure 4:
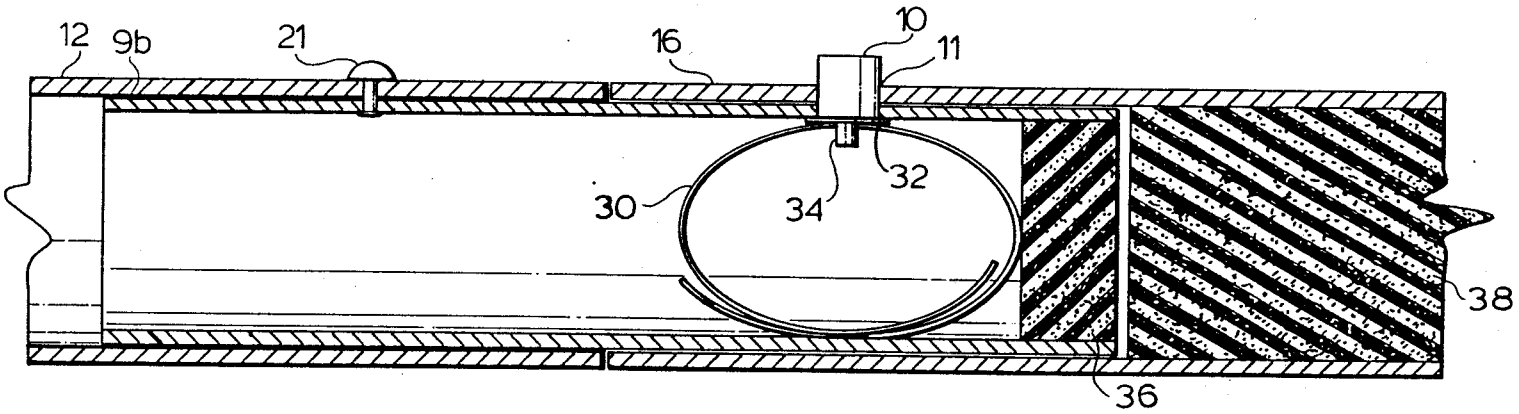
FIG. 4 is a longitudinal section, partly in elevation, showing a spring loaded button and light-weight rigid foam plastic.

FIG. 4 illustrates button 10 mounted in tube 9*b* and spring loaded by elliptical spring loop 30 to be biased outwardly to the operative position shown. Button 10 projects through opening 11 in the wall of the tube 9*b* and has a peripheral flange 32 wider than the said tube wall opening 11 to maintain button stud extension 34 within the tube 9*b*. Stud extension 34 projects through a hole in metal spring loop 30 to maintain spring loop 30 in compressive engagement with button 10.

Tube 9*b* may be riveted to an end of tube 12 by rivet 21 or connected to tube 12 by an identical second spring-loaded button 10. The exposed end of tube 9*b* and the open end of tube 16, for example, are filled with light-weight rigid foamed plastic 36, 38 respectively.

The shaft extension 12, handle 13, tubes 9 and paddle blade 15 may all be stored in a kit bag which can be fastened to the upper surface of a sailboard by some suitable means, such as for example straps which can be fastened to brackets mounted on the sailboard, or fastened to a seat of a canoe or small boat. Each component of the kit is sized to fit within the kit bag, which preferably has dimensions not greater than three feet in length by one foot in width by six inches in height.

It will be understood, of course, that modifications can be made in the embodiment of the invention illustrated and described herein without departing from the scope and purview of the invention as defined by the appended claims.

What is claimed as the invention is:

1. An emergency paddle kit for a sailboard having a boom, comprising, a paddle having a shaft with a free end and a blade formed at the opposite end of the shaft;

means positioned on the shaft for releasably attaching the shaft to the boom of the sailboard when the boom is in an operative sailing position, whereby that when the sail of the sailboard is not being used to propel the sailboard through the water, and the boom is in an inoperative position, said shaft may be released from the boom and the paddle may be used to propel the sailboard.

2. An emergency paddle kit as recited in claim 1 further comprising, a second paddle having a shaft with a free end and a blade formed at the opposite end of said second shaft;

means positioned on said second shaft for releasably attaching said second shaft to the boom of the sailboard; and means for connecting the free end of the first shaft to the free end of the second shaft;

whereby when the sail of the sailboard is not used to propel the sailboard throughout the water, said first and second shafts may be released from the boom and said first and second shafts may be connected together to form a kayak-type paddle which may then be utilized to propel the sailboard.

3. An emergency paddle kit as recited in claim 2 in which the free ends of the first and second shafts are hollow and the means for connecting the free ends of said first and second shafts comprises a tube of substantially the same diameter as the internal diameter of both of said first and second hollow shafts for insertion into said first and second shafts, said tube having at least at one end a spring-loaded button for releasable engagement with a button-shaped opening in one of said first and second shafts, and said tube being rigidly secured to the other of said first and second shafts.

4. An emergency paddle kit as recited in claim 1 in which at least two means are provided for releasably attaching the shaft to the boom of a sailboard, said first means being positioned proximate the paddle blade end of the shaft and said second means being positioned proximate the free end of the shaft.

5. An emergency paddle kit as recited in claim 2 in which at least first and second means are provided on each of the shafts of the first and second paddles for releasably attaching said shafts of the first and second paddles to the boom of a sailboard, each of said first means being positioned proximate the end of each of said first and second shafts at which the first and second paddle blades are formed and each of said second means being positioned proximate the free ends of each of said first and second shafts.

6. An emergency paddle kit as recited in claim 1, further comprising, selectively engageable with the free end of said shaft and with each other to produce various configurations as desired, one or more of the following components:

at least one shaft extension;

a paddle handle; and a second shaft with a second paddle blade attached to one end thereof.

7. An emergency paddle kit as recited in claim 6, in which each of said components and said shafts has a hollow shaft portion, and in which said selective engagement is by virtue of a tube of substantially the same diameter as the internal diameter of said shafts and shaft portions, said tube being rigidly connected at one end in a free end of a paddle shaft and having at the other end a spring-loaded button for releasable engagement with a button-shaped opening in the other paddle shaft upon insertion of said tube in the hollow shaft portion of the said other paddle shaft.

8. An emergency paddle kit comprising, in combination, a paddle having a hollow shaft and a blade formed at one end of the shaft, a first hollow shaft extension, means for joining the paddle shaft and the first shaft extension including a connector tube adapted to be inserted into the hollow paddle shaft and shaft extension and at least one spring-loaded button formed on said connector tube adapted to releasably engage a button-shaped opening formed in one of said paddle shaft or first shaft extension for releasably joining the paddle shaft and shaft extension together, a second paddle having a hollow shaft and a blade formed at one end of the shaft, a second hollow shaft extension, a second connector tube adapted to be inserted into the second paddle hollow shaft and second shaft extension, at least one spring-loaded button formed on said second connector tube adapted to releasably engage a button-shaped opening formed in one of said second paddle shaft or second shaft extension for releasably joining the second paddle shaft and second shaft extension together, and a third connector tube having two spaced apart spring-loaded buttons for releasable engagement with a button-shaped opening in each of the first and second hollow shaft extensions for releasably securing the shaft extensions together to form a kayak-type paddle.

9. An emergency paddle kit as claimed in claim 8 in which at least one of said connector tubes has a core of rigid foamed plastic.

* * * * *